US005395278A

United States Patent [19]

Dickhut

[11] Patent Number: 5,395,278

[45] Date of Patent: Mar. 7, 1995

[54] MANUALLY MANIPULATABLE FLEXIBLE TOY

[75] Inventor: Heinrich Dickhut, Charleston, Tenn.

[73] Assignee: Cullom Machine Tool & Die, Inc., Cleveland, Tenn.

[21] Appl. No.: 118,502

[22] Filed: Sep. 8, 1993

[51] Int. Cl.[6] ..... A63H 33/00

[52] U.S. Cl. ..... 446/486; 446/490; 446/491

[58] Field of Search ..... 446/486, 490, 491; 138/118, 119, 121; 285/921, 924, 7

[56] References Cited

U.S. PATENT DOCUMENTS

| | | | |
|---|---|---|---|
| 2,242,912 | 5/1941 | Healy | 446/26 |
| 2,667,371 | 1/1954 | Holte | 285/7 |
| 2,712,950 | 7/1955 | Siebert | 285/7 |
| 2,755,106 | 7/1956 | Brennan et al. | 285/7 |
| 3,277,927 | 10/1966 | Schneider | 138/121 |
| 3,899,012 | 8/1975 | Sather | 285/921 |
| 3,908,704 | 9/1975 | Clement et al. | 138/121 |
| 3,929,165 | 12/1975 | Diebolt et al. | 138/121 |
| 3,950,014 | 4/1976 | Doubleday | 285/7 |
| 4,080,752 | 3/1978 | Burge | 285/921 |
| 4,266,813 | 5/1981 | Oliver | 285/921 |
| 4,335,539 | 6/1982 | Jones | 446/486 |
| 4,523,780 | 1/1985 | Cheer | 285/921 |
| 4,593,690 | 6/1986 | Sheridan et al. | 138/119 |
| 4,775,564 | 10/1988 | Shriver et al. | 138/119 |

*Primary Examiner*—Robert A. Hafer
*Assistant Examiner*—Jeffrey D. Carlson
*Attorney, Agent, or Firm*—Wood, Phillips, VanSanten, Clark & Mortimer

[57] ABSTRACT

A manually manipulatable flexible toy includes an elongated tube unitarily fabricated of semi-rigid material such as plastic. The tube forms bellows which, in turn, define a plurality of larger diameter rings and a plurality of smaller diameter rings joined in an alternating array lengthwise of the tube by frusto-conical walls. The tube or any portion thereof is extendable and retractable and manipulatable into various curvilinear configurations, with the tube maintaining its last chosen extended or retracted or curvilinear condition. A pair of the frusto-conical walls diverge radially inwardly from any given larger diameter ring to an adjacent pair of smaller diameter rings when the tube is in the extended condition. A pair of the frusto-conical walls extend radially inwardly offset to one side of any given larger diameter ring when the tube is in the retracted condition. The tube is of a length sufficient to be curved into a closed configuration such as a circle and the like. Opposite ends of the tube are capable of being telescoped and coupled together.

3 Claims, 1 Drawing Sheet

Fig. 1
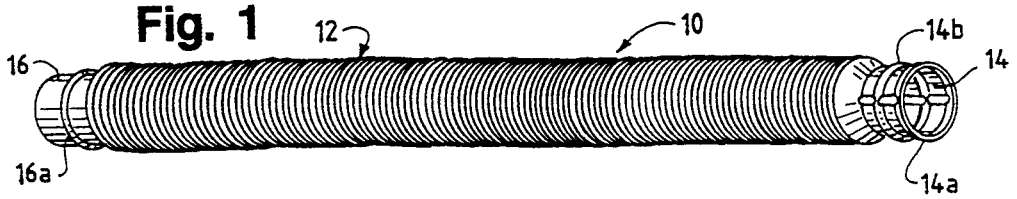
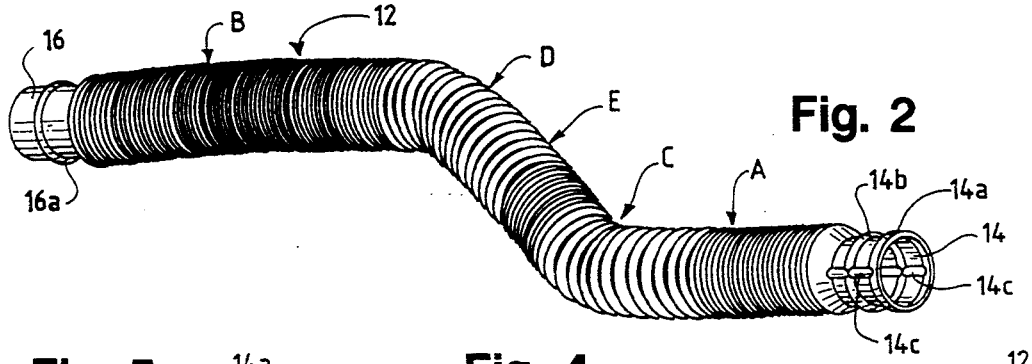
Fig. 2
Fig. 5
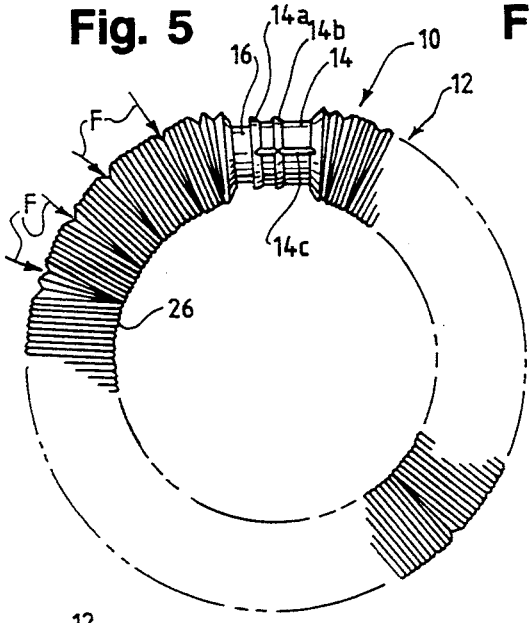
Fig. 4
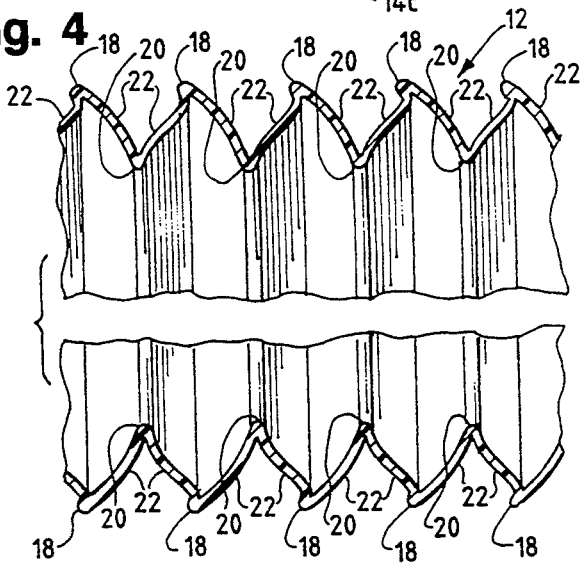
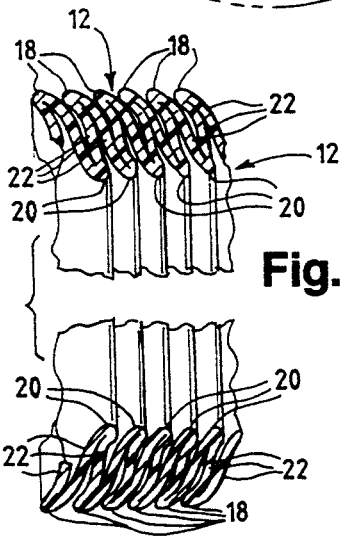
Fig. 3
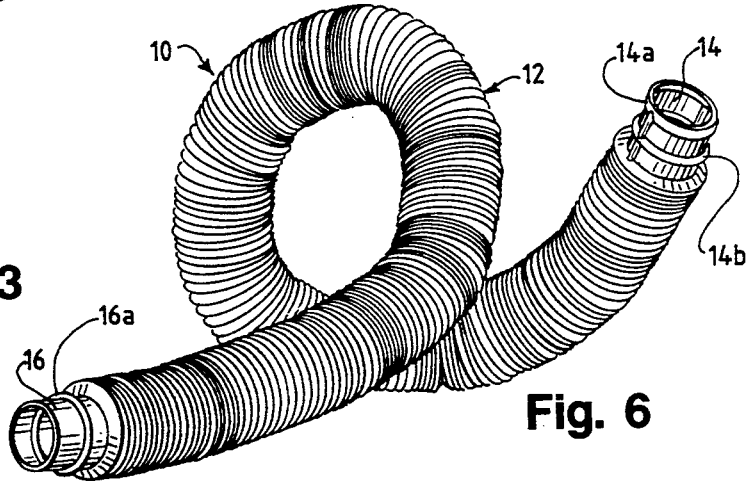
Fig. 6

MANUALLY MANIPULATABLE FLEXIBLE TOY

FIELD OF THE INVENTION

This invention generally relates to the art of toys or amusement devices and, particularly, to a flexible toy which is manually manipulatable into various shapes.

BACKGROUND OF THE INVENTION

All kinds of toys which are manually manipulatable into various shapes or configurations have been available for many years for use by children and adults, as well. Such toys range from quite complicated cubic puzzles to the very simple glob of moldable "clay". Most such toys do not have a plurality of separable parts or components. The enjoyment of the toys resides in the ability to change the shape, configuration or condition of the toy at the will or whim of the user. Simple toys of this nature are quite favorable for preschool children, because they do not involve various parts that can become lost and thereby destroy the complete effectiveness of the toy.

This invention is directed to providing a new and interesting toy of the character described above, which is a one-piece structure and which is capable of being manipulated into a myriad of shapes or configurations.

SUMMARY OF THE INVENTION

An object, therefore, of the invention is to provide a new manually manipulatable flexible toy.

In the exemplary embodiment of the invention, the toy is a one-piece structure in the form of an elongated tube unitarily fabricated of semi-rigid material. The tube forms bellows which, in turn, define a plurality of larger diameter rings and a plurality of smaller diameter rings joined in an alternating array lengthwise of the tube by frusto-conical walls. The tube or any portion thereof is extendable and retractable and manipulatable into various curvilinear configurations, with the tube maintaining its last extended or retracted or curvilinear condition.

In particular, a pair of the frusto-conical walls diverge radially inwardly from any given larger diameter ring to an adjacent pair of smaller diameter tings when the tube is in an extended condition. A pair of the frusto-conical walls extend radially inwardly offset to one side of any given larger diameter ring when in the retracted condition of the tube. As disclosed herein, the semi-rigid material of the tube consists of thermo-plastic material, such as polyvinyl chloride.

According to one aspect of the invention, opposite ends of the tube are of different diameters so that one end telescopes into the other end. Generally, complementary interengaging coupling means are provided between the opposite ends of the tube to hold the ends in the telescoped condition. In the preferred embodiment of the invention, the complementary interengaging coupling means are provided by snappingly engageable circumferential rib-and-groove means between the opposite ends of the tube.

According to another aspect of the invention, the tube is of a length sufficient to allow the tube to be bent back upon itself and, preferably, interconnected in a closed or circular condition. The coupling means can be used to hold the tube in that condition.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a perspective view of the manually manipulatable flexible toy of the invention in a straight or linear shape;

FIG. 2 is a perspective view of the toy shaped with two bends therein;

FIG. 3 is a fragmented axial section through the tube in its retracted condition;

FIG. 4 is a fragmented axial section of the tube in its extended condition;

FIG. 5 is an elevational view of the toy in a closed or circular shape with the opposite ends thereof coupled; and FIG. 6 is a perspective view of the toy in a looped shape.

DETAILED DESCRIPTION OF THE PREFERRED EMBODIMENT

Referring to the drawings in greater detail, and first to FIG. 1, the invention is embodied in a manually manipulatable flexible toy, generally designated 10, which includes an elongated tube, generally designated 12, between opposite ends 14 and 16. The entire structure, including tube 12 and ends 14 and 16, is a one-piece structure unitarily fabricated of semi-rigid material, such as polypropylene.

Tubular flexible toy 10 is manually manipulatable into practically a myriad of shapes or configurations. In its simplest form, elongated tube 12 can be extended and retracted in a straight-line configuration, as shown in FIG. 1, to many different lengths as will be understood hereinafter. FIG. 2 shows the toy manipulated into a shape which includes a linear section "A" adjacent end 14 and a linear section "B" adjacent end 16, with these linear sections generally parallel to each other. The linear sections are joined by curved sections "C" and "D", with an intermediate section "E" between the curved sections. In essence, the tube or any portion thereof is bendable into curvilinear configurations because the tube extends and retracts and maintains its last chosen extended or retracted or curvilinear condition by a construction described below.

More particularly, referring to FIGS. 3 and 4, an axial section of tube 12 is shown in FIG. 3 in a retracted condition, and an axial section of the tube is shown in FIG. 4 in an extended condition. The tube or any portion or axial section thereof will maintain either of these conditions, or a curved condition as described hereinafter.

Tube 12 is constructed with a plurality of larger diameter rings 18 and a plurality of smaller diameter rings 20 joined in an alternating array lengthwise of the tube by a plurality of frusto-conical walls 22. With this construction, and referring to FIG. 4, a pair of frusto-conical walls 22 diverge radially inwardly from any given larger diameter ring 18 to any adjacent pair of smaller diameter tings 20 when in the extended condition of the tube. On the other hand, each pair of the radially inwardly diverging walls 22 (as viewed in FIG. 4) will extend radially inwardly offset to one side of any given larger diameter ring 18 when the tube is in its retracted condition as seen in FIG. 3. Again, the tube or any portion or axial section thereof will maintain either of these conditions when manually manipulatable thereto.

Still further, when tube 12 is curved out of its linear configuration, a certain number of the ring areas will be extended on the outside radius of the curve and retracted on the inside radius of the curve. More particularly, reference is made to FIG. 5 wherein tube 12 has been manually manipulated into a closed or substantially uniform circular configuration, with opposite ends 14 and 16 coupled as described hereinafter. When the tube is curved, a certain number of ringed areas will become extended only on the outside of the curve as indicated by arrows "F" in FIG. 5. In each one of these ringed areas, it can be seen that a pair of frusto-conical walls between an adjacent pair of larger diameter tings converge toward the smaller diameter ring therebetween. Yet, in each ringed area "F", the tube is retracted about the inside circumference 26 of the closed/circular configuration. This extended-on-the-outside/retracted-on-the-inside condition of the ringed areas will result whenever tube 12 is bent or manually manipulated into curves, such as curved sections "D" and "C" in FIG. 2.

A unique affect of the extendable toy of the invention is an audible affect created when elongated tube 12 is extended. Specifically, each time one of the ringed areas transforms from its retracted condition (FIG. 3) to its extended condition (FIG. 4), it essentially "snaps" to the extended condition. This occurs as each smaller diameter ring moves from its offset retracted condition to one side of a larger diameter ring, overcenter toward its extended condition on the opposite side of the same larger diameter ring. This snapping action creates a distinct snapping or popping sound. The faster the action, the louder will be the sound. When a whole series of ringed areas are extended by rapid pulling on the elongated tube, a relatively loud staccato type audible effect is created.

The invention contemplates that elongated tube 12 which forms substantially the entire length of flexible toy 10 be sufficiently long that the tube can be bent back on itself and even manipulated into a closed configuration, such as the circular shape shown in FIG. 5. Many other configurations with a tube of substantial length can only be imagined, but another configuration is shown in FIG. 6 wherein the elongated tube is bent completely back upon itself to form a "loop" with ends 14 and 16 extending away from the loop in opposite directions.

As stated briefly above in relation to the closed or circular configuration of tube 12 in FIG. 5, opposite ends 14 and 16 of the tube are provided with complementary interengaging coupling means to connect the tube in a closed configuration, such as the circle in FIG. 5. More particularly, end 14 has a slightly larger diameter than end 16 so that end 16 can be telescoped into end 14. End 14 has a flared distal edge **14*a* to facilitate inserting end 16 thereinto. Larger diameter end 14 has a unitarily molded, outwardly projecting circumferential rib 14*b*, and smaller-diameter end 16 has a unitarily molded, outwardly projecting circumferential rib 16*a*. When end 16 is telescoped into end 14 as seen in FIG. 5, rib 16*a* snappingly engages within rib 14*b* to couple the ends together. The ends are separated simply by pulling thereon and, thereby, removing rib 16*a* from within rib 14*b*. In essence, rib 14*b* defines an internal groove within end 14 for snappingly receiving outwardly projecting rib 16*a* of end 16**.

Lastly, one or both of the opposite ends 14 and 16 may be provided with one or more axially extending, unitarily molded ribs for the passage of air therethrough. For instance, FIGS. 2 and 5 show that end 14 has a pair of axially extending ribs **14*c*. These ribs provide passages or channels to allow air to flow into and out of elongated tube 12** when the ends are coupled and uncoupled. Otherwise, a vacuum could be created within the tube in a closed condition and make it difficult to uncouple the toy.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A one-piece manually manipulatable flexible toy comprising an elongated tube unitarily fabricated of semi-rigid material, the tube forming bellows which, in turn, define a plurality of larger diameter rings and a plurality of smaller diameter rings joined in an alternating tray lengthwise of the tube by frusto-conical walls, the tube or any portion thereof being extendable and retractable and manipulatable into various curvilinear configurations with the tube maintaining its last chosen extended or retracted or curvilinear condition, wherein a pair of said frusto-conical walls diverge radially inwardly from any given larger diameter ring to an adjacent pair of smaller diameter rings when the tube is in said extended condition, wherein a pair of said frusto-conical walls extend radially inwardly offset to one side of any given larger diameter ring when the tube is in said retracted condition, said tube having two non-bellowed end portions and being of a length sufficient to be manipulated into a closed configuration such as a circle and the like, the opposite end portions of the tube being of different diameters so that one end portion telescopes into the other end portion, and at least one opposite end portion of the tube including an axial rib which defines a passage extending longitudinally for the length of the two coupled end portions and communicating with the interior of the tube when said opposite end portions are coupled to allow air to flow into and out of the tube.

2. The manually manipulatable flexible toy of claim 1 wherein said semi-rigid material comprises thermo-plastic material.

3. A one-piece manually manipulatable flexible toy comprising an elongated tube unitarily fabricated of semi-rigid material, the tube forming bellows which allow the tube or any portion thereof to be extended and retracted and manipulated into various curvilinear configurations, said tube being of a length sufficient to be manipulated into a closed configuration such as a circle and the like, the opposite ends of tile tube having non-bellowed end portions of different diameters so that one end portion telescopes into the other end portion, and at least one opposite end portion of the tube including an axial rib which defines a passage extending longitudinally for the length of the two coupled end portions and communicating with tile interior of tile tube to allow air to flow into and out of the tube when the opposite ends are coupled.

* * * * *